US008459330B2

(12) United States Patent
Sterling et al.

(10) Patent No.: US 8,459,330 B2
(45) Date of Patent: Jun. 11, 2013

(54) METHOD FOR THE PRODUCTION OF PIGS, AND PIGS

(76) Inventors: Evgenij Sterling, Esslingen (DE); Hugo Berger, Waldenbuch (DE)

( * ) Notice: Subject to any disclaimer, the term of this patent is extended or adjusted under 35 U.S.C. 154(b) by 767 days.

(21) Appl. No.: 11/919,782

(22) PCT Filed: Apr. 26, 2006

(86) PCT No.: PCT/EP2006/003853
§ 371 (c)(1),
(2), (4) Date: Jan. 13, 2009

(87) PCT Pub. No.: WO2006/117111
PCT Pub. Date: Nov. 9, 2006

(65) Prior Publication Data

US 2009/0304542 A1 Dec. 10, 2009

(30) Foreign Application Priority Data

May 4, 2005 (DE) ..... 10 2005 021 891

(51) Int. Cl.
*B22D 3/00* (2006.01)
*B22D 27/02* (2006.01)
*B22D 46/00* (2006.01)

(52) U.S. Cl.
USPC ..... 164/4.1; 164/47; 164/498

(58) Field of Classification Search
USPC ..... 164/4.1, 47, 48, 498, 499
See application file for complete search history.

(56) References Cited

U.S. PATENT DOCUMENTS

| | | | | |
|---|---|---|---|---|
| 7,264,037 | B2 | 9/2007 | Kuroki et al. | 164/71.1 |
| 2002/0179280 | A1 * | 12/2002 | Peleschka et al. | 164/499 |
| 2004/0055734 | A1 | 3/2004 | Hong et al. | 164/499 |
| 2004/0055735 | A1 | 3/2004 | Hong et al. | 164/499 |
| 2004/0211541 | A1 | 10/2004 | Hong | 164/113 |
| 2006/0151137 | A1 | 7/2006 | Kuroki et al. | 164/113 |

FOREIGN PATENT DOCUMENTS

| | | | |
|---|---|---|---|
| CN | 1485452 | A | 3/2004 |
| DE | 100 02 670 | A1 | 8/2001 |
| EP | 1 405 684 | A1 | 4/2004 |
| EP | 1 405 684 | A2 | 4/2004 |
| EP | 1405684 | A2 * | 4/2004 |
| EP | 1 445 044 | A2 | 8/2004 |
| EP | 1 470 876 | A1 | 10/2004 |
| JP | 10137930 | A | 5/1998 |
| JP | 2002059247 | A | 2/2002 |

(Continued)

OTHER PUBLICATIONS

Japanese Search Report Dated Feb. 2, 2010.

(Continued)

*Primary Examiner* — Kevin P Kerns
(74) *Attorney, Agent, or Firm* — K&L Gates LLP

(57) ABSTRACT

Methods for producing pigs made of a metal alloy, wherein initially a melt is formed in which a basic material and one or several alloy components are present in the liquid state, from which the pigs are formed. In the course of cooling, energy in the form of a variable field, which increases the formation of mixed crystals, is briefly introduced into the melt prior to the formation of the pigs. A pig thereby produced is a cast piece formed from a basic material and one or several alloy components and has been formed from a melt into which energy had been briefly introduced by a variable physical field in order to increase mixed crystal formation.

5 Claims, 1 Drawing Sheet

FOREIGN PATENT DOCUMENTS

| | | | |
|---|---|---|---|
| JP | 2002327231 | A | 11/2002 |
| JP | 2003183756 | A | 7/2003 |
| JP | 2004114152 | A | 4/2004 |
| JP | 2004114156 | A | 4/2004 |
| JP | 2004131762 | A | 4/2004 |
| JP | 2005021943 | A | 1/2005 |
| WO | WO 2005/002760 | A1 | 1/2005 |

OTHER PUBLICATIONS

Japanese Office Action, dated Aug. 9, 2011.
State Intellectual Property Office, P.R. China, Office Action, dated Mar. 6, 2009.
Korean Intellectual Property Office, Office Action, dated Aug. 20, 2012.

* cited by examiner

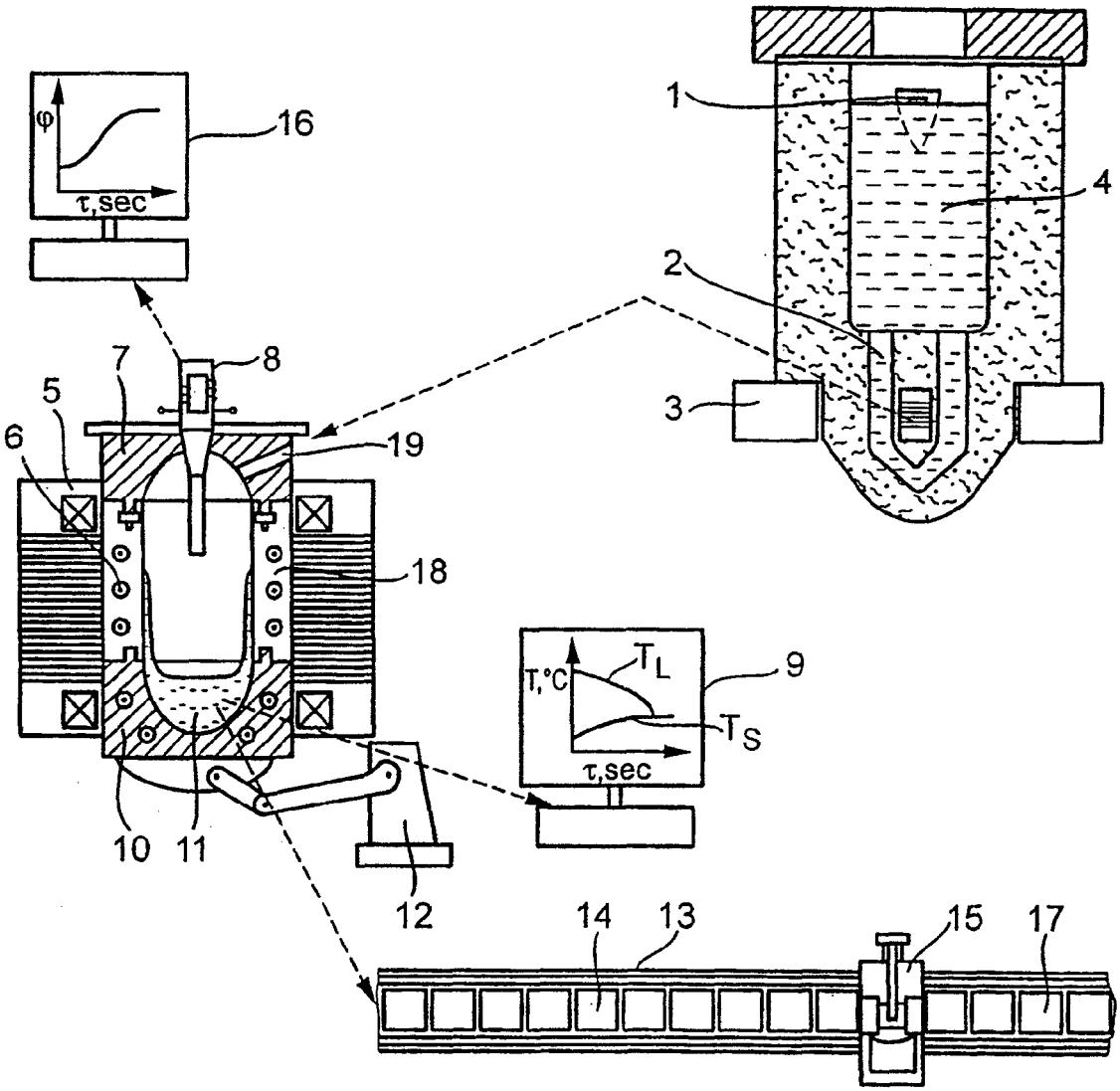
φ
τ,sec
16
1
4
2
3
7
8
5
6
19
18
T,°C
$T_L$
$T_S$
τ,sec
9
10
11
12
14
13
15
17

METHOD FOR THE PRODUCTION OF PIGS, AND PIGS

CROSS-REFERENCES TO RELATED APPLICATIONS

This application claims the benefit of German patent application 10 2005 021 891.1, filed May 4, 2005, herein incorporated by reference.

BACKGROUND OF THE INVENTION

The invention relates to methods for producing pigs made of a metal alloy, wherein a melt is formed in which a basic material and one or several alloy components are present in the liquid state, from which the pigs are formed.

As a rule, aluminum or aluminum alloys are made available as semi-finished products in the form of two- or three-piece pigs for further processing by casting. For producing the pigs, a melt of the appropriate metal alloy is formed, which is then cast into pig molds.

For improving the quality of the cast pieces made from such pigs it is also known (German Patent Publication DE 10002670 A1) to melt the pigs in a furnace and then to expose the melt to a rotating electromagnetic field in a treatment chamber and to cast the melt treated in this way. This method leads to a considerable improvement of the cast parts.

SUMMARY OF THE INVENTION

The object of the invention is based on providing a method for producing pigs which, in the course of further treatment, leads to cast workpieces with improved qualities without it being necessary to make changes in existing casting machinery.

This object is attained in that, in the course of cooling, energy which increases the formation of mixed crystals is briefly introduced into the melt by means of a variable physical field prior to the formation of the pigs.

By means of the invention it is achieved that initially mixed crystal elementary cells are created, in which atoms of the basic metal are substituted by atoms of the additive component(s). The formation of enriched mixed crystals is achieved in a specific manner, wherein the saturation threshold and the range of the concentration temperature interval is controlled by means of the exterior variable physical field, so that mixed crystals are created, which are supersaturated with foreign atoms. The saturation threshold and the increased diffusion of foreign atoms into the space lattice of the basic material is not a function of temperature. A quite fine-grained structure made of these mixed crystals is created during continued cooling.

It is provided in the course of developing the invention that the supply of energy takes place at a temperature approximately at the liquidus level of this metal alloy.

The time during which the energy supply is to be provided should be experimentally determined. It is a function of the specific metal alloy and also of the means by which the energy supply is performed. For determining the time period for charging with energy it is provided in accordance with a first embodiment that the mixed crystal formation is detected by measuring the dynamic viscosity of the melt located in the treatment chamber. The invention assumes that an optimum of mixed crystal formation shows up when the treated melt has reached a particularly fluid state in spite of cooling, which remains approximately constant and then does no longer significantly change. In another embodiment of the invention it is provided that the formation of mixed crystals is detected by means of measurements of the liquidus temperature of samples taken from the treatment chamber. Here the invention assumes that the actual liquidus temperature appears as a kink in the cooling curve, which is created as a result of the crystallization heat. In case of successful treatment, the actual liquidus temperature lies below the liquidus curve provided by a status diagram for this metal alloy.

In a further embodiment of the invention it is provided that the short-time energy supply takes place by means of a varying, preferably pulsating electromagnetic field.

It has been surprisingly shown that pigs produced in this way have the increased flowability produced with the help of treatment in the electromagnetic field in the manner of a memory effect, even if they are melted again and processed in casting machinery. In contrast to pigs produced in accordance with conventional methods, pigs processed in this way show increased flowability, so that it is possible to produce cast pieces of complicated shapes and increased density. Cast pieces produced in this way have increased stability, improved stretching properties and improved wear properties. Because of this they can partially replace components which up to now had to be forged.

In contrast to the method known from German Patent Publication DE 10002670 A1 there results the considerable advantage that it is not necessary to place an appropriate treatment chamber upstream of every casting machine. It is possible to employ the same casting machinery used for processing conventional pigs, without it being necessary to make changes in the machine. The casting temperature can be reduced, even the liquidus temperature of the respective alloy. The temperature range within which casting becomes possible is increased, so that the danger of waste because of unsuitable casting temperatures is considerably reduced.

BRIEF DESCRIPTION OF THE DRAWING

Further characteristics of the invention ensue from the following description with reference to the accompanying drawing depicting an installation suitable for the production in accordance with the invention of pigs in accordance with the invention.

DETAILED DESCRIPTION OF THE PREFERRED EMBODIMENTS

The components of a metal or a metal alloy are heated in a melting furnace, having a casting opening 1, a melt channel 2 and an electrical heater 3, to such a degree that all components are melted and form a melt 4.

This melt 4 is transported through a filler opening 19 into a treatment chamber. This treatment chamber consists of a substantially cylindrical housing part 18, a hemispherical lower part 10 and an approximately hemispherical upper part 7. A preferably electrical heater 6 in the form of heating coils is assigned to the treatment chamber, by means of which the treatment chamber is heated to the range of, and for example slightly below, the liquidus curve of the specific metal alloy, for example to the eutectic temperature of the metal alloy. Additionally, an installation 5 for introducing energy, for example by generating a rotating electromagnetic field, is assigned to the treatment chamber. This electromagnetic field has a field strength of, for example, 6 to 20 mT and rotates at a frequency of approximately 60 Hz to 500 Hz. A hydrodynamic pressure of an order of magnitude of $150\times10^{-4}$ N/m$^2$ is therefore created. In the course of the mutual effect of the isotropic magnetic pressure and the magnetic tension, whose optimal range lies between 15 and 80 mT, the effect of a fluid-elastic anomaly develops in the melt, which is characterized by the greatest flowability of the metallic melt. It then has the lowest dynamic viscosity. A dynamic viscosity of 0.74 mPa/s was measured at a melt temperature of 580° C. A thermo-kinetic anomaly of the treated melt can also be observed, which is defined by the shrinkage of the area between the liquidus temperature and the solidus temperature to a minimum value. The complete solubility of several components added by alloying also exists at the solidus temperature. The two-phase shrinks continuously because of the drop in the liquidus temperature and the simultaneous rise in the solidus temperature, so that the tie line becomes shorter. Once the desired state has been reached, the melt 11 removed from the treatment chamber by means of a robotic removal device 12 and poured into pig molds 14, which are transported on a pig conveyor 13. The pig molds 14 are emptied at an emptying device 15, so that empty pig molds 17 can then again be supplied to the robotic removal device 12.

The brief introduction of energy into the melt, which is in the cooling phase, leads to an increase in the formation of mixed crystals, wherein atoms of the basic material in the elementary crystals are replaced by atoms of the added component(s). The supply of energy can be terminated once the process of mixed crystal formation has reached its optimum and a further energy supply does no longer decisively increase the mixed crystal formation. This optimum, which characterizes the new energetic state of the melt, is detected in an embodiment form of the invention.

The greatest flowability or lowest viscosity, which is an indication of the increased mixed crystal formation, is measured online in the treatment chamber by means of a viscosimeter 8, so that it can always be determined whether the desired state of the melt 11 has been reached. The energetic state of the liquid-crystalline basic crystal is changed by the external energetic effect. Its space lattice is loosened, so that the process in which new atomic groups are constructed is made easier. The energy and the linkage forces appearing between the atoms of the individual components and structural units of the metal alloys are among the important factors. Viscosity is one of these properties. The structure and conversion of atomic complexes leads to a release of strong linkages which were more likely formed in the interior of the complex. These linkages participate in the viscous flow and also in the shifting of structural units. Therefore a drop in viscosity is attributed to an atomic complex having the weakened interior and strengthened exterior linkages. In the course of this the technological-physical requirements are created, under which collective areas with a uniform orientation are built up in the liquid-crystalline system. The new structuring and its energetic stability are reinforced by the variable electromagnetic field. The result is the reduced viscosity, which reflects the energetic state of the space lattice, or of the structural micro-units of the melt. For example, flowability can be displayed on a monitor 16. Maximum flowability has been reached when the flowability no longer rises substantially, i.e. has reached the approximately horizontal branch of the curve of the flowability $\phi$ over the time t displayed on the monitor 16.

Alternatively, or possibly even additionally, it is provided for samples of the melt 11 to be taken out of the treatment chamber and analyzed. For example, by means of this analysis it is possible to indicate on a further monitor 9 how the liquidus temperature $T_L$ changes and has approached the solidus temperature Ts compared to the liquidus curve of the special metal alloy. It is possible here to display a representation of the temperature T over time t on a monitor 9. The build-up process of the supersaturated mixed crystal, which had started in the liquid-crystalline system, is terminated in the course of cooling of the alloy, so that the preparation of a realistic status diagram is possible. A large spectrum of alloy properties is covered by means of this thermodynamic representation, for example a statement regarding the concentration, liquidus-solidus curve arrangement, saturation threshold (solubility), etc., which make it possible to determine the suitable technical casting parameters for the alloy prepared in accordance with the method in accordance with the invention.

If pigs produced in accordance with the above methods are further processed, it has been surprisingly shown that advantageous conditions result. The increase in flowability obtained because of the treatment is not reversible, because the mixed crystals are stable. The melt produced in the course of further processing of the remelted pigs has improved flowability and a lesser tendency toward oxidation. Less dross is created at the bath surface when the pigs are remelted.

In connection with a metal alloy with the basic material aluminum and the main alloy component silicon it has still been possible to successfully cast cylinder heads at a casting temperature of 637° C., which thus was lower by approximately 100° C. than the casting temperature prescribed for this machine and this alloy. In spite of the lower casting temperature there were no reductions in quality because of shrinkage, gas porosity or cold flow, and no ragged structure formation.

The invention assumes that strengthening of the diffusion process and inter-atomic connections are affected by the exterior energetic effect, i.e. by the interaction between an exterior electromagnetic field and an interior electromagnetic field of the crystal. The result of this interaction is the build-up of an alloy whose crystals, in the molten state, show an extensive order, or remote order. This interaction can also be controlled in that an alloy component is added which differs from the basic material by magnetic susceptibility.

The invention is particularly suitable for metal alloys in which the basic material is aluminum and the main added component is silicon. However, the invention is basically usable for all metal alloys without regard to magnetic susceptibility of the components. In the exemplary embodiment, the exterior energetic action is provided by means of a varying, pulsing electromagnetic field. However, other options are easily provided for exterior energetic actions by means of a variable physical field, for example an action by means of ultrasound. In this case the field is laid out in such a way that the requirements resulting in accordance with the previously explained electromagnetic field are also obtained.

The pigs in accordance with the invention are suitable for all casting processes. Here, in case of chilled casting the great flowability is of particular advantage, while in case of die-casting the excellent deformability is of particular advantage. It is assumed that when remelting the pigs the new atomic arrangement in the space lattice, which was obtained by pre-treatment by diffusion, is also kept when remelting the pigs, without the atoms of the alloy components giving up their spaces in the aluminum space lattice.

In accordance with the invention, the expression pigs is understood to mean not only commercially available forms of pigs. Instead, this is understood to be every mold into which a prepared melt is cast prior to remelting for a casting process.

The invention claimed is:

1. A method for producing pigs made of a metal alloy, wherein initially a melt is formed in which a basic material and one or several alloy components are present in a liquid state, from which the pigs are formed, comprising the steps of:

loading the melt into a treatment chamber, which treatment chamber is heated to the range of the liquidus level of the metal alloy, cooling the melt, in the course of cooling the melt, increasing the formation of mixed crystals by introducing a supply of energy into the melt by means of a variable field prior to the formation of the pigs, detecting mixed crystal formation by measuring the dynamic viscosity of the melt in a treatment chamber, terminating the supply of energy into the melt after the process of mixed crystal formation has reached a predetermined optimum at which a further energy supply no longer decisively increases mixed crystal formation, and removing the melt from the treatment chamber and pouring it into pig molds.

2. A method in accordance with claim 1, characterized in that the supply of energy takes place at a temperature approximately at the liquidus level of the metal alloy.

3. A method in accordance with claim 1, characterized in that the formation of mixed crystals is detected by means of measurements of the liquidus temperature of samples taken from the treatment chamber.

4. A method in accordance with claim 1, characterized in that the supply of energy takes place by means of a varying electromagnetic field.

5. A method in accordance with claim 4, wherein the varying electromagnetic field is a pulsating electromagnetic field.

* * * * *